US005691093A

United States Patent [19]

Kanbayashi et al.

[11] Patent Number: 5,691,093

[45] Date of Patent: Nov. 25, 1997

[54] METHOD OF FORMING A FULL-COLOR TONER IMAGE ONTO A LAMINATED FILM

[75] Inventors: Makoto Kanbayashi, Kawasaki; Takashige Kasuya, Soka; Tatsuya Nakamura, Tokyo; Tatsuhiko Chiba, Tokyo; Kazuyuki Miyano, Tokyo, all of Japan

[73] Assignee: Canon Kabushiki Kaisha, Tokyo, Japan

[21] Appl. No.: 506,177

[22] Filed: Jul. 25, 1995

Related U.S. Application Data

[63] Continuation of Ser. No. 83,936, Jun. 28, 1993, abandoned.

[30] Foreign Application Priority Data

Jun. 29, 1992 [JP] Japan ..... 4-192707

[51] Int. Cl.[6] ..... G03G 13/20

[52] U.S. Cl. ..... 430/47; 430/124; 430/126

[58] Field of Search ..... 430/124, 126, 430/47; 427/198

[56] References Cited

U.S. PATENT DOCUMENTS

| | | | |
|---|---|---|---|
| 3,876,463 | 4/1975 | Cree | 430/126 |
| 4,937,168 | 6/1990 | Platzer | 430/143 |
| 5,013,629 | 5/1991 | Sekine et al. | 430/138 |
| 5,055,329 | 10/1991 | Namiki et al. | 430/257 |
| 5,273,855 | 12/1993 | Omote et al. | 430/143 |
| 5,281,504 | 1/1994 | Kanbayashi et al. | 430/124 |

FOREIGN PATENT DOCUMENTS

| | | |
|---|---|---|
| 349227 | 1/1990 | European Pat. Off. . |
| 393592 | 10/1990 | European Pat. Off. . |
| 501360 | 9/1992 | European Pat. Off. . |
| 36-10231 | 7/1936 | Japan . |
| WO90/13064 | 11/1990 | WIPO . |

*Primary Examiner*—Christopher D. RoDee

*Attorney, Agent, or Firm*—Fitzpatrick, Cella, Harper & Scinto

[57] ABSTRACT

An image forming method has developing an electrostatic latent image on an electrostatic latent image bearing member by the use of a toner containing a wax component, to form a toner image on the electrostatic latent image bearing member;

transferring the toner image to the surface of a recording medium; and fixing the toner image on the recording medium, to the recording medium.

The recording medium has a laminated film having a substrate layer and a wax component absorption layer for absorbing a wax component contained in the toner. The wax component absorption layer is formed of a resin capable of inhibiting crystal growth of the wax component. The wax component absorption layer is capable of absorbing the wax component contained in the toner when the toner image is fixed to the recording medium.

112 Claims, 3 Drawing Sheets

METHOD OF FORMING A FULL-COLOR TONER IMAGE ONTO A LAMINATED FILM

This application is a continuation of application Ser. No. 08/083,936 filed Jun. 28, 1993, now abandoned.

BACKGROUND OF THE INVENTION

1. Field of the invention

This invention relates to an image forming method comprising developing an electrostatic latent image by the use of a toner to form a toner image on an electrostatic latent image bearing member, transferring the toner image to the surface of a recording medium and fixing to the recording medium the toner image formed on the surface of the recording medium. More particularly, it relates to an image forming method that forms a full-color toner image on a recording medium using a transparent laminated film as the recording medium.

2. Related Background Art

A usual full-color toner image forming method conventionally available will be described.

A photosensitive layer on a photosensitive drum serving as the electrostatic latent image bearing member, is electrostatically uniformly charged by means of a primary corona assembly, and imagewise exposure is carried out using laser light modulated by magenta image signals of an original, to form an electrostatic latent image on the photosensitive drum. The electrostatic latent image is developed by a magenta toner held in a magenta developing assembly, to form a magenta toner image. Next, to a recording medium transported, the magenta toner image developed on the photosensitive drum is transferred by means of a transfer corona assembly.

Meanwhile, the photosensitive drum from which the toner image has been transferred to the recording medium is destaticized by means of a residual charge eliminator, and is further cleaned through a cleaning means. Thereafter, it is again electrostatically charged by the primary corona assembly, and a cyan toner image is similarly formed. The cyan toner image is transferred to the recording medium on which the magenta toner image has been formed, and then a yellow toner image and a black toner image are successively formed in the same way so that the magenta, cyan, yellow and black, four color toner images are transferred to the recording medium. The recording medium having the four color toner images is fed to a fixing roller so that they are fixed to the recording medium by the action of heat and pressure. Thus, a full-color fixed toner image is formed.

The toner used in the fixed color toner image forming method is required to have good melt properties and color-mixing properties, and preferably also have a low softening point, a low melt viscosity and high sharp melt properties.

Use of the toner having high sharp melt properties makes it possible to broaden the range of color reproduction of copied matter and obtain color copies faithful to original images.

Such a toner having high sharp melt properties, however, has so high an affinity for the fixing roller that it tends to offset to the fixing roller during fixing.

In particular, in the case of a fixing means in the full-color toner image forming method, the offset particularly tends to occur since a plurality of toner layers corresponding to magenta, cyan, yellow and black are formed on the recording medium.

Hence, in conventional instances, a release agent such as silicone oil is applied to the fixing roller in order to improve the releasability of toner from the fixing roller. Such an image forming method, however, have caused the following problems.

There arise the problems that, because of the application of a release agent such as oil to the fixing roller, the construction of the main body of an apparatus becomes complicated and also the application of oil may accelerated shorten the lifetime of the fixing roller.

Moreover, with a recent demand for various modes of copying, it is being prevalent to form a fixed toner image by using as a recording medium a film made of resin as exemplified by transparent films for overhead projectors (OHPs). When, however, the toner image is fixed to the film by the above fixing method making use of an oil at the time of fixing, the oil used may adhere to the surface of the film to have often caused a great lowering of the quality of the film that receives the resulting toner image.

Accordingly, much hope has been put in the establishment of a fixing system that requires no application of oil in the course of fixing and the development of a novel toner capable of achieving its establishment, having solved the above problems.

To cope with the above subject, a toner containing a release agent such as wax or a toner prepared by suspension polymerization is proposed (Japanese Patent Publication No. 36-10231). This suspension polymerization is a process in which polymerizable monomers and a colorant (optionally together with a polymerization initiator, a cross-linking agent, a charge control agent and other additives) are uniformly dissolved or dispersed to prepare a monomer composition, and thereafter this monomer composition is dispersed in a continuous phase (e.g., an aqueous phase) containing a dispersion stabilizer, by means of a suitable stirrer, at the same time with which polymerization reaction is carried out to obtain toner particles having the desired particle diameter.

In this suspension polymerization, liquid droplets of the monomer composition are produced in a greatly polar dispersion medium such as water, and hence components having polar groups, contained in the monomer composition, tend to localize at the surface layer which is an interface with the aqueous phase and non-polar components do not tend to be present at the surface layer, giving what is called a quasi capsulate structure. Making the most of the feature of this preparation process, it is possible to incorporate a low-melting wax that can not be used in pulverization which is other toner preparation process.

Because of this encapsulation of a low-melting wax, the toner obtained by polymerization can achieve both the anti-blocking and the low-temperature fixing that are performances conflicting each other. More specifically, the encapsulation of a low-melting wax brings about an improvement in thermal conductivity in toner on account of the wax that melts at a low temperature, without causing a lowering of anti-blocking properties, so that it becomes possible to carry out low-temperature fixing. What is more preferable is that the wax having melted in the course of fixing also serves as a release agent and hence it becomes possible to prevent high-temperature offset without any release agent such as oil applied to the fixing roller.

Although the toner obtained by polymerization, comprising a wax encapsulated into toner particles, can certainly exhibit an advantageous performance in the course of fixing, it has caused other problems that when transparent films are used the transparency of images having been fixed may be a little lowered and also that the wax encapsulated as a release agent exudes in the course of fixing to flow out of images.

More specifically, as shown in FIG. 3, the wax encapsulated into toner particles melts out by the action of pressure and heat in the course of fixing and flows over a transparent film made of resin, a recording medium R having no absorptivity to the wax, in such a way that it is pressed out toward the rear side of the forward direction P of the film. Hence, wax W flows from the rear end of a fixed image I, so that the image becomes unsuitable as an image used for OHPs.

In order to prevent this flow of wax, one may contemplate to decrease the amount of the wax contained in the toner. This manner, however, results in a decrease in the release properties of the toner. If on the other hand the wax is encapsulated into toner particles in an amount larger than a certain amount so that a satisfactory release effect can be obtained, the above phenomenon can not be avoided after all.

This is due to the following: The deterioration of quality as stated above can not be seen in recording mediums such as paper since the absorptivity of the paper itself allows the paper to absorb the wax melting out. However, the recording mediums made of resin, such as OHP films, have no absorptivity, and hence the wax having melted out remains on the surface as it is, and flows out to non-image areas.

Toner images on the recording medium are also required to have high light transmission properties when fixed toner images are formed on the recording mediums such as transparent films made of resin. Hence, it is well common to make fixing speed lower than that in the fixing carried out on recording mediums such as plain paper, to make the toner sufficiently melt.

In such a case, however, the toner on the recording medium more remarkably tends to offset to the fixing roller during fixing. Hence, in order to obtain a satisfactory release effect, the amount of the wax encapsulated into toner particles must be set a little larger than that in the case when toner images are fixed to recording mediums such as paper.

In the method of forming toner images by the use of such a toner comprising a wax encapsulated into toner particles, it has been ascertained that the transparency of transparent films is lowered because of milky-whitening accompanied with crystallization of the wax itself. This is considered due to the following: The wax encapsulated into toner particles exudes therefrom to a toner layer on a recording medium when it passes through the fixing roller, and consequently the wax having exuded covers the surface of the toner image or part thereof, resulting in an increase in its crystallinity with a drop of temperature after it has passed the roller, to make light transmission properties extremely poor.

Now, it is urgently sought to provide any countermeasure by which the recording mediums such as the transparent films made of resin may bear no marks of the flow of wax in the course of fixing even if the wax is encapsulated in a sufficient quantity to some extent.

Meanwhile, when color toner images or full-color color toner images are formed on a transparent film by using an electrophotographic system having a dry development system and the images formed are projected using an OHP, a phenomenon may occur in which, even though the images on the film show a satisfactory color formation, the projected images have a grayish tone as a whole to give a very narrow range of color reproduction. This phenomenon occurs because an unfixed toner image formed on a smooth film can not be made well fluid by the heating in the course of fixing and remains particulate, to cause scattering of incident light and form a shade on the screen. In particular, in neutral-tone areas having a low image density, the absorption ascribable to a dye or pigment in the toner becomes lower because of a decrease in the number of toner particles, and the resulting absorption level becomes equal to the level of black absorption ascribable to scattering of toner particles, so that the color tone to be reproduced becomes grayish.

In the case when toner images on recording mediums such as plain paper are viewed, reflected images of light shed on fixed toner images are viewed. Hence, the toner surface remaining more or less particulate may have less influence on image quality. On the other hand, in the case when toner images are viewed through transmitted light or projected on a screen as in OHPs, light transmission properties may become poor because of scattering of light if any residual shape ascribable to toner particles is clear. Accordingly, recording mediums used in OHPs are required to be effective in making the toner less particulate after the fixing, improving light transmission properties and also decreasing the offset to the fixing roller during fixing.

SUMMARY OF THE INVENTION

An object of the present invention is provide an image forming method that has solved the problems discussed above.

Another object of the present invention is to provide an image forming method that can obtain fixed toner images with a superior quality, without use of any oil in the step of fixing.

Still another object of the present invention is to provide an image forming method that can obtain fixed color toner images with a superior transparency and a good quality.

A further object of the present invention is to provide an image forming method that can obtain fixed toner images with a good quality, without causing flow-out of wax components contained in a toner, when toner images are fixed.

A still further object of the present invention is to provide an image forming method that can obtain fixed toner images capable of giving a color or full-color projected image having a good color tone reproduction without making the projected image grayish as a whole when used in overhead projectors (OHPs).

A still further object of the present invention is to provide an image forming method that can obtain fixed toner images in a good anti-offset performance in the course of fixing.

The present invention provides an image forming method comprising;

developing an electrostatic latent image on an electrostatic latent image bearing member by the use of a toner containing a wax component, to form a toner image on the electrostatic latent image bearing member;

transferring said toner image to the surface of a recording medium; and fixing said toner image on the recording medium, to said recording medium;

wherein said recording medium comprises a laminated film having a substrate layer and a wax component absorption layer for absorbing a wax component contained in said toner; said wax component absorption layer being formed of a resin capable of inhibiting crystal growth of said wax component; and said wax component absorption layer being capable of absorbing the wax component contained in the toner, when the toner image is fixed to the recording medium.

DESCRIPTION OF THE PREFERRED EMBODIMENTS

Figure 1:
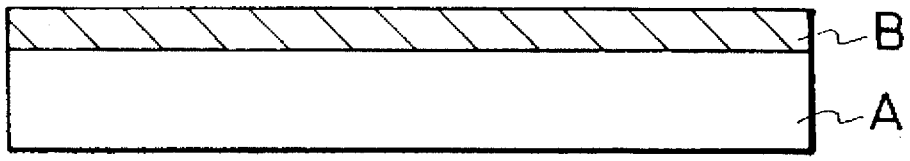
FIG. 1 cross-sectionally illustrates an example of the recording medium used in the present invention.

The toner used in the present invention comprises a wax component encapsulated into toner particles in a large quantity, and hence the wax having melted in the course of fixing effectively serves as a release agent. Thus, it has become possible to prevent high-temperature offset without any application of a release agent such as oil to the fixing roller.

It, however, has been ascertained that the transparency of images after fixing becomes extremely low when transparent films are used as recording mediums.

This is due to the fact that the wax having exuded from the insides of toner particles in the course of fixing covers the surface of the toner image or part thereof, resulting in an increase in crystallinity of the wax with a drop of temperature after it has passed a fixing means, to make light transmission properties extremely poor. The present inventors has solved this problem by employing a recording medium with the structure described above.

A specific embodiment of the recording medium used in the present invention will be described below in order.

The recording medium used in the present invention comprises a laminated film having a substrate layer and a wax component absorption layer made of synthetic resin for absorbing a wax component contained in the toner, formed on the top side of the substrate layer.

In the present invention, the wax component absorption layer must be formed of a resin capable of inhibiting crystal growth of the wax component.

In the present invention, the resin capable of inhibiting crystal growth of the wax component is defined to be a resin that forms the wax component absorption layer and whose light transmittance measured according to the procedure as will be described later in Examples is increased by a rate of 20% or more, i.e., a resin that forms the wax component absorption layer, capable of increasing light transmittance by 20% or more in an image-fixed recording medium (i) compared with light transmittance in an image-fixed recording medium (ii) when a toner image formed using a toner containing a wax component is fixed to each of a recording medium (i) comprising a substrate layer on which the wax component absorption layer has been formed and a recording medium (ii) comprising a substrate layer on which no wax component absorption layer has been formed.

Formation of the wax component absorption layer by the use of this resin capable of inhibiting crystal growth of the wax component makes it possible to prevent crystal growth of the wax component and thereby to improve transparency of the recording medium.

What is called "wax", which is so commonly called, causes deposition of crystals upon cooling and shortly grows into large tabular crystals. The tabular crystals are said to be entangled one another to form a three-dimensional network structure to turn into a giant crystal.

Of course, if such a highly crystalline wax component covers the surface of a fixed image, incident light is scattered and the full-color image having been fixed to a recording medium becomes grayish as a whole, resulting in a poor color reproduction.

When viewed from such a mechanism, it follows that the crystal growth of the wax may be controlled in order to improve the transparency of films. Since what is called the crystal growth takes place when what resemble one another get together, it follows that in order to inhibit this growth the properties of the surfaces of crystal species of the wax may be modified by such a means that the crystals are covered with other substance or incorporated into other substance at the time they begin to come into being, i.e., when they stand small crystal species immediately after passing through a fixing means.

On the basis of the above idea, the present inventors have investigated substances having a great intertwinement with the wax.

As a result, in the first place, the present inventors have discovered that, as the resin capable of inhibiting crystal growth of the wax component, use of a non-polar resin having an affinity for the wax component as exemplified by an unsaturated resin having no functional group in its molecular structure can remarkably lower the crystal growth of wax to bring about an improvement in transparency of recording mediums to which toner images have been fixed.

Because of no functional group in the molecular structure, the affinity of the wax component can be improved, and also because of unsaturated bonds therein, the crystal growth of the wax component can be lowered, so that it becomes possible to effectively inhibit the crystal growth of the wax component.

Such a resin may include, for example, resins substituted from diene monomer or ene monomer, to which examples are by no means limited.

The resin that forms the wax component absorption layer should preferably have a thermal resistance to such an extent that may cause no remarkable thermal deformation during the fixing of toner images.

The resin synthesized from diene monomer or ene monomer may include, for example, polybutadiene, polyisoprene, poly(1-chloro-1-butylene), poly(octachloro-4-methyl-1-butylene), poly(4-methyloxy-1-butylene), poly(1-phenyl-1-butylene), polyvinylethylene, poly(methoxycarbonyl-3-methyl- 1-butylene), poly(1,2-dimethyl-1-butylene) and poly(1-t-1-butylene). It may also be a copolymer of a polymerizable monomer containing the diene component constituting these polymers with a vinyl type polymerizable monomer. A resin synthesized from the above diene monomer or ene monomer and a polymer formed using the following vinyl type polymerizable monomers may also be used in the form of a mixture.

The above usable vinyl type polymerizable monomers can be exemplified by styrene monomers such as styrene, o-methylstyrene, m-methylstyrene, p-methylstyrene, p-methoxylstyrene and p-ethylstyrene; acrylates such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and other monomers such as acrylonitrile, methacrylonitrile and acrylamide. Examples are by no means limited to these.

These monomers may be used alone with respect to the diene monomer as a two-monomer diene copolymer, or plural kinds of monomers may be used in combination as a three- or more-monomer diene copolymer. Modified products obtained by subjecting diene compounds to maleic treatment, phenolic treatment or epoxydation may also be used.

In the second place, the present inventors have discovered that, as the resin capable of inhibiting crystal growth of the wax component, use of a non-polar resin having in its molecular structure both a methylene chain or long-chain alkyl group having a structure similar to the wax and a polar group or aromatic group having a structure different from the wax, as exemplified by a random polymer or block copolymer of an α-olefin with a vinyl monomer having a polar group or aromatic group, can remarkably lower the crystal growth of wax to bring about an improvement in transparency of recording mediums to which toner images have been fixed.

The random polymer or block copolymer of an α-olefin with a vinyl monomer having a polar group or aromatic group may specifically include the following resins (a) and (b).

(a) α-Olefin/maleate copolymers or α-olefin/maleic anhydride copolymers.

(b) Ethylene/vinyl acetate copolymers or ethylene/acrylate copolymers.

In the present invention, the resin that forms the wax component absorption layer may preferably have a higher melting point than the melting point of the wax component contained in the toner, and also its temperature difference of not more than 100° C.

If the resin component that forms the wax component absorption layer has a lower melting point than the melting point of the wax component contained in the toner, the recording medium substrate and the wax component absorption layer may have a poor thermal stability when images formed on the recording medium are fixed, tending to cause separation of the wax component absorption layer from the recording medium substrate.

If the difference in the melting point of the resin component that forms the wax component absorption layer from the melting point of the wax component contained in the toner is more than 100° C., the wax component absorption layer may have a low wax component absorption power to cause a deterioration of transparency of the recording medium having a fixed toner image thereon.

In the present invention, the melting point of the resin that forms the wax component absorption layer on the surface of the recording medium and that of the wax component contained in the toner are measured by DSC, and are temperatures corresponding to maximum absorption peaks in that measurement.

The measurement by DSC is made under conditions of temperatures raised at a rate of 10° C./min in the range of from −20° C. to 250° C., which are set holding at 250° C. for 5 minutes and then dropped at intervals of −10° C./min. DSC curves are thus obtained, from which the melting points are measured. As a measuring apparatus, DSC-7, manufactured by Parkin Elmer Co., is used.

With regard to those having a decomposition temperature of 250° C. or below in the resin that forms the wax component absorption layer, the temperatures are dropped from a temperature lower than that to make measurement by DSC.

The recording medium used in the present invention will be specifically described below with reference to FIG. 1.

In FIG. 1, A denotes a base film serving as the substrate layer of the recording medium, the laminated film made of transparent resin. The base film A must have a thermal resistance that may cause no remarkable thermal deformation upon heating when heat fixing or heat-pressure fixing is carried out. The base film A should preferably have a thermal deformation temperature of 145° C. or above, and more preferably 150° C. or above, under measuring conditions of 4.6 kg/cm$^2$ as prescribed in ASTM-D648. Stated specifically, the base film A can be exemplified by polyethylene terephthalate (PET), polyester, polyamide or polyimide, having a thermal deformation temperature of 145° C. or above and a thermal resistance at a highest service temperature of 100° C. or above. Of these, polyethylene terephthalate is particularly preferred in view of thermal resistance and transparency. The base film A must have a thickness that may cause no wrinkle when the film becomes soft upon heating in the course of fixing. In the case of polyethylene terephthalate, it may have a thickness of 50 μm or more. Even in the case of the transparent film, its light transmittance may be lowered with an increase in thickness. Hence, the base film A should preferably have a layer thickness of from 50 to 300 μm, more preferably from 70 to 200 μm, and still more preferably from 70 to 150 μm.

A wax component absorption layer B is formed on the surface of the base film A of the recording medium of the present invention. As a method for its formation, there is a method in which the resin that forms the wax component absorption layer B is dissolved in a volatile organic solvent comprising an alcohol such as methanol or ethanol or a ketone such as methyl ethyl ketone or acetone and the resulting solution is coated on the surface of the transparent base film A by a coating process such as bar coating, dip coating, spray coating or spin coating. In some instances, in order to improve the adhesion between the wax component absorption layer B and the base film A so as not to cause separation of fixed toner images from the base film A during fixing or after fixing, the surface of the base film A may be subjected to surface treatment such as plasma treatment or corona discharge treatment, or may be provided with an adhesive layer having a compatibility with both the base film A and the wax component absorption layer B and also having a thermal resistance high enough for the layer not to melt upon heating in the course of fixing. Resins that can be used to form the adhesive layer may include resins such as polyester resin, acrylate resin, methacrylate resin, a styrene/acrylate copolymer and a styrene/methacrylate copolymer.

The wax component absorption layer B must have a layer thickness of at least 0.5 μm, though somewhat variable depending on toner particle diameters used. A wax component absorption layer with a thickness less than 0.5 μm makes it difficult to well inhibit the crystallization of the wax used in a minimum amount necessary for well exhibiting release properties, and that with a thickness more than 30 μm may result in a large quantity of molten resin when heat-fixing is carried out, tending to cause unfocused images or distorted images and also tending to cause a decrease in transparency of the transparent sheet itself.

Thus, the wax component absorption layer of the recording medium used in the present invention may preferably have a thickness of from 0.5 μm to 30 μm, more preferably from 1 μm to 20 μm, and still more preferably from 1 μm to 10 μm.

The toner used in the image forming method of the present invention will be described below.

Toners used in color electrophotographic apparatus are required to exhibit good melt properties and color-mixing properties when heat is applied. It is preferable to use toners having a low softening point, having a low storage elastic modulus at fixing temperatures and having sharp melt properties, where pulverization toners or polymerization toners are used.

As the pulverization toner used in the present invention, a toner obtained through the steps of melt-kneading, pulverization and classification can be used. As polymers used in a binder resin of the toner, it is possible to use resins obtained by polymerizing monomers such as acids such as acrylic acid, methacrylic acid and maleic acid, esters thereof, polyesters, polysulfonates, polyethers and polyurethanes, or resins obtained by polymerizing two or more kinds of these monomers. The toner can be obtained by well kneading any of these resins and other toner component materials including the wax component, by means of a heat kneader such as a heat roll, a kneader or an extruder, followed by mechanical pulverization and classification.

In the toner obtained by kneading these toner component materials followed by pulverization and classification, the wax component should preferably be in a content of from 0.1 to 10% by weight, more preferably from 0.5 to 7% by weight, based on the weight of the toner.

Its use in a content less than 0.1% by weight can be less effective for the release of the toner in the course of fixing, and its use in a content more than 10% by weight may result in a low uniform dispersibility of the wax component in the toner, tending to cause localization of the wax component.

The polymerization toner used in the present invention can be obtained by the process as described below.

In polymerizable monomers, additives such as a charge control agent, a release agent and a colorant are added, which are heated until they dissolve or melt, and uniformly dissolved or dispersed by means of a mixing machine such as a homogenizer or an ultrasonic dispersion machine to give a monomer composition. This composition is dispersed in an aqueous phase having substantially the same temperature as a monomer system containing a dispersion stabilizer, by means of a mixing machine such as a homomixer or a homogenizer. Stirring speed and stirring time are controlled so that monomer droplets can have the desired toner particle size, usually particle diameters of 30 μm or less. Thereafter, stirring may be carried out to such an extent that the state of particles is maintained and the particles can be prevented from settling, by the action of the dispersion stabilizer. Polymerization temperature is set at a temperature not higher than the temperature at which the release agent is deposited, and a polymerization initiator is added to carry out polymerization. After the reaction has been completed, the toner particles formed are washed and collected by filtration, followed by drying. In the suspension polymerization, water may preferably be used as a dispersion medium usually in an amount of from 300 to 3,000 parts by weight based on 100 parts by weight of the monomer composition.

The polymerizable monomers usable in the above polymerization toner may include styrene monomers such as styrene, o-methylstyrene, m-methylstyrene, p-methylstyrene, p-methoxystyrene and p-ethylstyrene; acrylates such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and other monomers such as acrylonitrile, methacrylonitrile and acrylamide.

These monomers may be used alone or in combination of two or more kinds. Of the above monomers, it is preferred in view of developability and durability of the toner to use styrene or styrene derivatives alone or in combination or in the form of a mixture with other monomers.

In the dispersion medium used when the above polymerization toner is produced, a dispersion stabilizer such as polyvinyl alcohol, gelatin, methyl cellulose, methyl hydroxypropylcellulose, ethyl cellulose, a sodium salt of carboxymethyl cellulose, polyacrylic acids and salts thereof, starch, tricalcium phosphate, aluminum hydroxide, magnesium hydroxide, calcium metasilicate, barium sulfate or bentonite can be used by dispersing it in the aqueous phase. This dispersion stabilizer may preferably be used in an amount of from 0.2 part to 20 parts by weight based on 100 parts by weight of the polymerizable monomers.

In order to finely disperse the dispersion stabilizer, a surface active agent may also be used in an amount of from 0.001 to 0.1 part by weight based on 100 parts by weight of the polymerizable monomers. This surface active agent is used to accelerate the intended action of the dispersion stabilizer. As examples thereof, it may include sodium dodecylbenzenesulfonate, sodium tetradecylsulfate, sodium pentadecylsulfate, sodium octylsulfate, sodium oleate, sodium laurate, potassium stearate and calcium oleate.

To the monomer composition, a polymer or copolymer having a polar group may preferably be added as an additive to carry out the polymerization. In the present invention, it is also preferable to carry out the polymerization while a monomer composition to which a polymer, copolymer or cyclized rubber having a polar group has been added is suspended in an aqueous phase in which a dispersant with a chargeability reverse to that of the polar polymer has been dispersed. More specifically, a cationic polymer, copolymer or cyclized rubber or an anionic polymer, copolymer or cyclized rubber and a reverse-chargeability anionic or cationic dispersant dispersed in the aqueous phase are electrostatically attracted to each other on the surfaces of particles being formed into a toner during the polymerization in progress, so that the dispersant covers the particle surfaces to prevent particles from cohering one another and to stabilize them. At the same time, the polar polymers added during polymerization gather on the surface layers of the particles being formed into a toner, and hence they take the form of a sort of shells. Thus, the resulting particles have a quasi capsulate structure. The relatively high-molecular weight polymer, copolymer or cyclized rubber having a polar group is used so that properties excellent in anti-blocking and anti-offset can be imparted to toner particles, and in the meantime the polymerization is carried out so that in the inside it can contribute an improvement in fixing performance at a relatively low molecular weight, so that a toner satisfying the conflicting requirements, the fixing performance and the anti-blocking properties, can be obtained.

Examples of the polymer and copolymer having a polar group and the reverse-chargeability dispersant that are usable in the present invention are shown below.

(1) The cationic polymer may include polymers of nitrogen-containing monomers as exemplified by dimethylaminoethyl methacrylate and diethylaminoethyl methacrylate, or copolymers of such nitrogen-containing monomers with styrene or unsaturated carboxylic acid esters.

(2) The anionic polymer may include polymers of nitrile monomers such as acrylonitrile, halogen-containing monomers such as vinyl chloride, unsaturated carboxylic acid monomers such as acrylic acid and methacrylic acid, as well as unsaturated dibasic acids, unsaturated dibasic acid anhydrides and nitro monomers, or copolymers of such monomers with styrene monomers.

A cyclized rubber may be used in place of these polar polymers.

(3) The anionic dispersant may include fine silica powder. In particular, colloidal silica having a BET specific surface area of 200 $m^2/g$ or more is preferred.

(4) The cationic dispersant may include hydrophilic positively chargeable fine silica powder such as aminoalkyl-modified colloidal silica (preferably having a BET specific surface area of 200 $m^2/g$ or more), or aluminum hydroxide.

Such a dispersant should preferably be used in an amount of from 0.2 part to 20 parts by weight, and more preferably from 0.3 part to 15 parts by weight, based on 100 parts by weight of the polymerizable monomers.

In the present invention, a charge control agent may preferably have been added in the toner for the purpose of controlling the chargeability of the toner. Among known charge control agents, those almost having neither polymerization inhibitory action nor aqueous-phase transfer properties can be used as the charge control agent. A positive charge control agent may include, for example, Nigrosine dyes, triphenylmethane dyes, quaternary ammonium salts, amine type compounds and polyamine type compounds. A negative charge control agent may include, for example, metal-containing salicylic acid compounds, metal-containing monoazo dye compounds, a styrene-acrylic acid copolymer and a styrene-methacrylic acid copolymer.

As the colorant used in the present invention, known colorants can be used, as exemplified by dyes such as carbon black, black iron oxide, C.I. Direct Red 1, C.I. Direct Red 4, C.I. Acid Red 1, C.I. Basic Red 1, C.I. Mordant Red 30, C.I. Solvent Red 49, C.I. Solvent Red 52, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4 and C.I. Basic Green 6; and pigments such as chrome yellow, cadmium yellow, mineral fast yellow, navel yellow, Naphthol Yellow S, Hanza Yellow G, Permanent Yellow NCG, Tartrazine Lake, molybdenum orange, Permanent Orange GTR, Benzidine Orange G, cadmium red, Permanent Red 4R, Watchung Red calcium salt, Brilliant Carmine 3B, Fast Violet B, Methyl Violet Lake, prussian blue, cobalt blue, Alkali Blue Lake, Victoria Blue Lake, quinacridone, disazo type yellow pigments, Phthalocyanine Blue, Fast Sky Blue, Pigment Green B, Malachite Green Lake and Final Yellow Green. When in the present invention the toner is obtained by polymerization, attention must be paid to the polymerization inhibitory action and aqueous-phase transfer properties inherent in the colorant. The colorant should mope preferably be previously subjected to surface modification, for example, hydrophobic treatment using a material free from inhibition of polymerization.

The wax as the release agent contained in the toner used in the present invention may include paraffin waxes, polyolefin waxes and modified products of these (e.g., oxides or graft-treated products), higher fatty acids and metal salts thereof, amide waxes and ester waxes, to which examples are by no means limited.

The wax contained in the toner used in the present invention should preferably have a melting point of from 30° to 150° C., and more preferably from 40° to 140° C. If its melting point is lower than 30° C., the toner may have no satisfactory anti-blocking properties and shape retention. If it is higher than 150° C., the release properties can not be well effective.

The melting point is calculated from temperatures of maximum absorption peaks according to DSC.

The wax contained in the toner used in the present invention may preferably have a melting calorie $\Delta H$ of from 50 to 250 J/g.

Such a wax should preferably be used in an amount of from 0.1 part to 50 parts by weight, more preferably from 1 part to 45 parts by weight, and more preferably from 5 to 40 parts by weight, based on 100 parts by weight of the polymerizable monomers. If the wax is less than 0.1 part by weight, release properties can be less effective. If it is more than 50 parts by weight, production stability may become lower and also anti-blocking properties and storage stability tend to become lower.

The polymerization initiator may include, for example, azo or diazo type polymerization initiators such as 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropylperoxy carbonate, cumene hydroperoxide, 2,4-dichlorobenzoyl peroxide and lauroyl peroxide. As a redox initiator, reduing agents such as diemthylaniline, mercaptans, tertiary amines, ferrous salts and sodium hydrogensulfite may also be used in combination with the peroxides listed above. These polymerization initiators are preferably used in order to obtain the desired molecular weight, and can be enough if added in an amount of from 0.1 to 10% by weight based on the weight of the polymerizable monomers.

The release agent, polymerization initiator and polymerization temperature in the present invention will be further detailed below.

When a wax usually having a low melting point or softening point as exemplified by paraffin wax is used as the release agent, the polymerization temperature also becomes lower because of a lowering of the temperature at which the release agent is deposited from the polymerizable monomer composition. In such a case, it is preferred to use the redox initiator or an initiator with a short half-life as exemplified by 2,2'-azobis-4-methoxy-2,4-dimethylvaleronitrile.

When a wax usually having a high melting point or softening point as exemplified by polyolefin wax is used as the release agent, an autoclave is preferably used in order to dissolve or melt the release agent in the polymerizable monomer composition. Since the temperature at which the release agent is deposited is relatively higher than in the case of the above high-melting or high-softening wax such as paraffin wax, it is also preferred to use a polymerization initiator such as 2,2'-azobis-(2,4-dimethylvaleronitrile) or dimethyl-2,2'-azobisisobutyrate.

Known additives may be used in the toner of the present invention for the purpose of providing various properties. The additives may preferably have a particle diameter of not more than 1/10 of the volume average diameter of the toner particles in view of their durability when added to the toner. This particle diameter of the additives is meant to be an average particle diameter measured using an electron microscope by observing surfaces of toner particles. As these properties-providing additives, for example, the following can be used.

1) Fluidity-providing agents: Metal oxides such as silicon oxide, aluminum oxide and titanium oxide, carbon black, and carbon fluoride. These may more preferably have been subjected to hydrophobic treatment.

2) Abrasives: Metal oxides such as cerium oxide, aluminum oxide, magnesium oxide and chromium oxide, nitrides such as silicon nitride, carbides such as silicon carbide, and metal salts such as strontium titanate, calcium sulfate, barium sulfate and calcium carbonate.

3) Lubricants: Fluorine resin powders such as vinylidene fluoride and polytetrafluoroethylene, and fatty acid metal salts such as zinc stearate and calcium stearate.

4) Charge controlling particles: Metal oxides such as tin oxide, titanium oxide, zinc oxide, silicon oxide and aluminum oxide, and carbon black.

Any of these additives may be used in an amount of from 0.1 part to 10 parts by weight, and preferably from 0.1 part to 5 parts by weight, based on 100 parts by weight of the toner particles. These additives may be used alone or in combination of plural ones.

A full-color image forming method according to the present invention will be described below.

Figure 2:
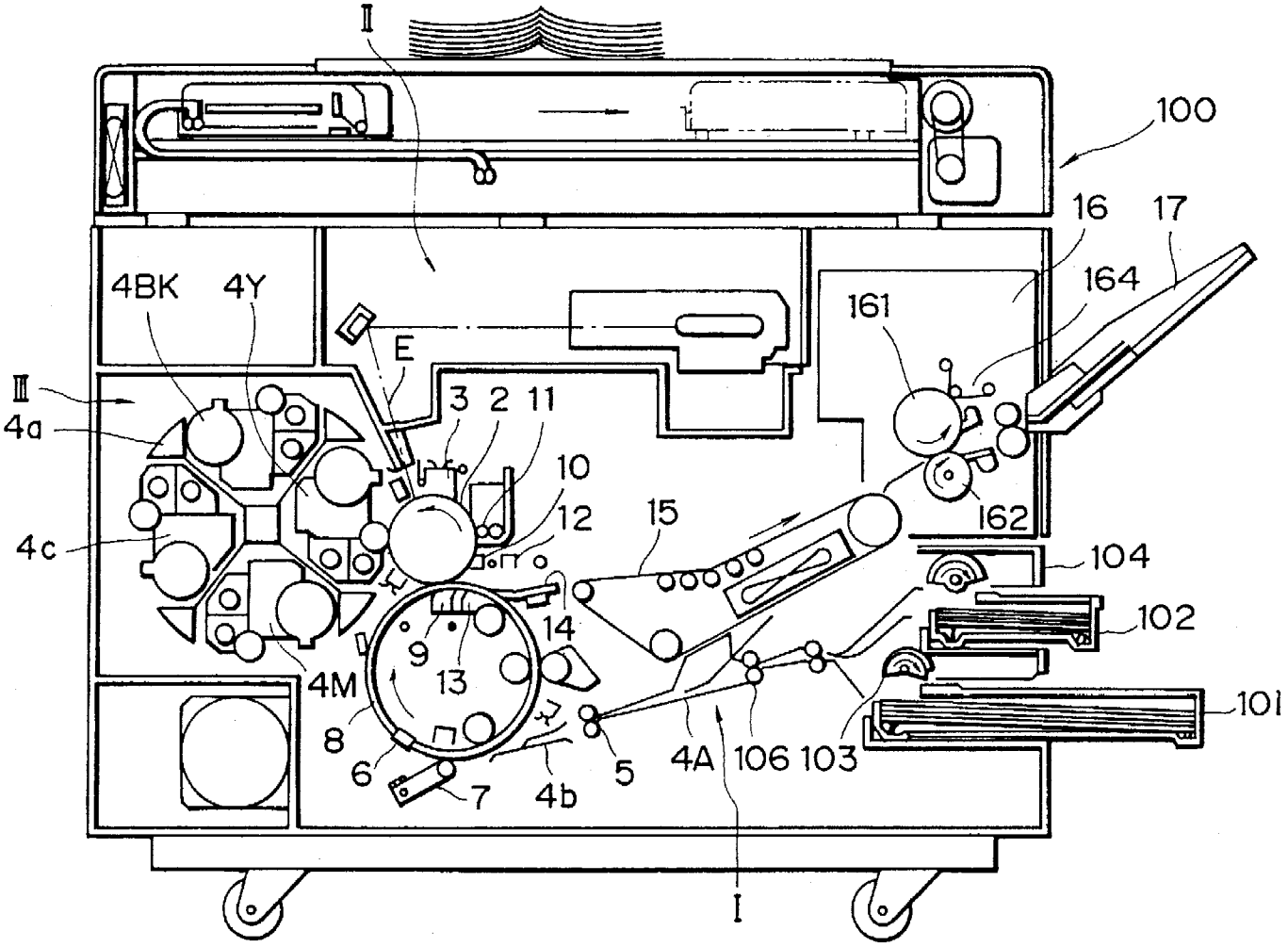
FIG. 2 is an illustration used to describe the image forming method of the present invention.
Figure 3:
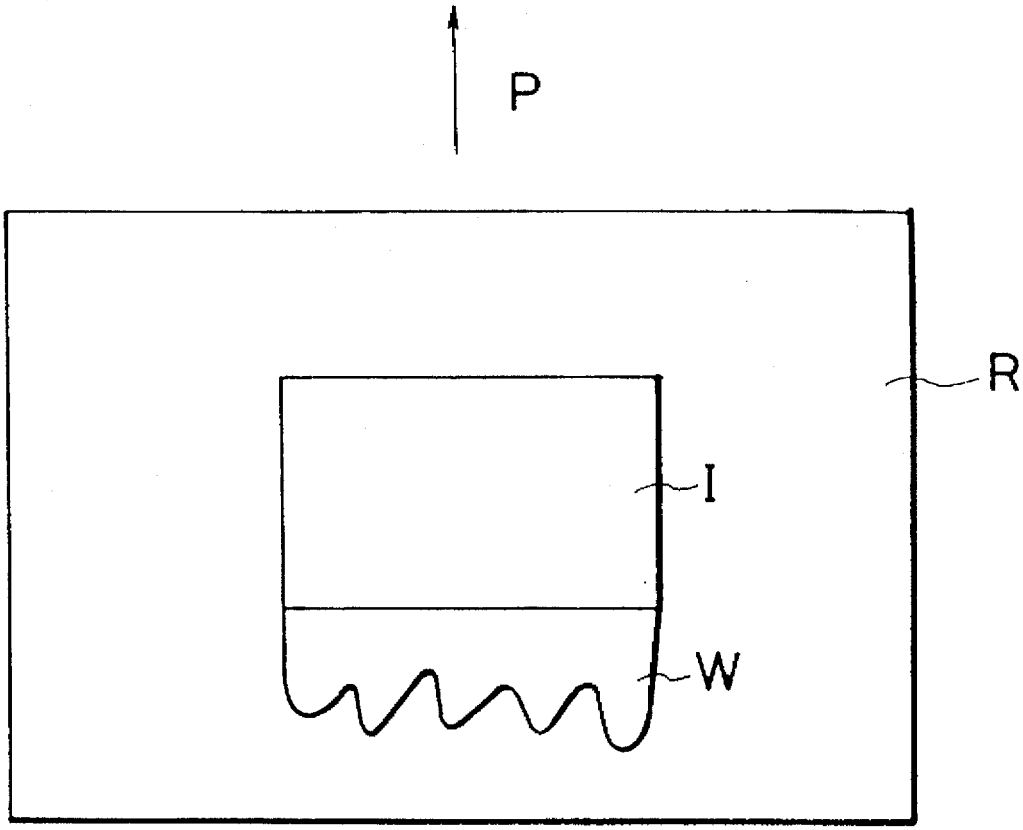
FIG. 3 is an illustration used to point out a problem caused when an image is formed using a conventional recording medium.

FIG. 2 schematically illustrates a cross section of an electrophotographic apparatus that can form full-color images according to the present invention. In the drawing, the apparatus is roughly grouped into a recording medium transport system I so provided as to extend from the right side (the right side in FIG. 2) of the main body 100 of the apparatus to substantially the middle of the main body 100 of the apparatus, a latent image forming zone II provided in substantially the middle of the main body 100 of the apparatus and in proximity to a transfer drum 8 constituting the recording medium transport system I, and a developing means, i.e., a rotary developing unit III, provided in proximity to the latent image forming zone II. The recording medium transport system I described above is provided with recording medium feeding trays 101 and 102 detachable from openings formed on the right side (the right side in FIG. 2) of the main body 100 of the apparatus; paper feed rollers 103 and 104 provided almost directly above the trays 101 and 102, respectively; paper guides 4A and **4*b* provided in proximity to these paper feed rollers 103 and 104 and equipped with a paper feed roller 106; and a contacting roller 7, a gripper 6, a recording medium separating corona assembly 12 and a separating claw 14 which are provided in proximity to the paper feed guide 4*b* and arranged in the vicinity of the periphery of the transfer drum 8 from the upstream side to the downstream side in the direction of its rotation; and is also provided with a transfer corona assembly 9 and a recording medium separating corona assembly 13 inside the periphery of the transfer drum 8. It further comprises the transfer drum 8 rotatable in the direction of an arrow in FIG. 2, a paper delivery belt means 15 provided in proximity to the separating claw 14, and a fixing assembly 16 provided in proximity to a paper output tray 17 detachable from the main body 100 of the apparatus, provided in proximity to the terminal side of the paper delivery belt means 15 in the direction of paper delivery and extending to the outside of the main body 100** of the apparatus.

The latent image forming zone II is equipped with a electrostatic latent image bearing member (i.e., a photosensitive drum 2) so provided that its periphery comes into contact with the periphery of the transfer drum 8 and also it is rotatable in the direction of an arrow in FIG. 2; a residual charge eliminating corona assembly 10, a cleaning means 11 and a primary corona assembly 3 which are provided in the vicinity of the periphery of the photosensitive drum 2 from the upstream side to the down stream side in the direction of rotation of the photosensitive drum 2; an imagewise exposure means such as a laser beam scanner to form an electrostatic latent image on the periphery of the photosensitive drum 2; and an imagewise exposing light reflecting means such as a polygon mirror.

The rotary developing unit III comprises a rotatable housing (hereinafter "rotating support") **4*a*, and a yellow developing assembly 4Y, a magenta developing assembly 4M, a cyan developing assembly 4C and a black developing assembly 4BK which are independently mounted in the rotating support and so constructed that electrostatic latent images formed on the periphery of the photosensitive drum 2 can be converted into visible images (i.e., developed) at positions facing the periphery of the photosensitive drum 2**.

The sequence of the whole image forming apparatus constructed as described above will be described by giving an example of full-color mode image formation. With the rotation of the above photosensitive drum 2 in the direction of the arrow in FIG. 2, a photosensitive layer on the photosensitive drum 2 is electrostatically uniformly charged by means of the primary corona assembly 3. Upon the uniform charging on the photosensitive layer by means of the primary corona assembly 3, imagewise exposure is carried out using laser light E modulated by yellow image signals of an original (not shown), so that an electrostatic latent image is formed on the photosensitive drum 2, and then the electrostatic latent image is developed by means of the yellow developing assembly 4Y previously set stationary at a developing position by the rotation of the rotating support **4*a***.

The recording medium transported through the paper feed guide 4A, paper feed roller 106 and paper feed guide **4*b* is held fast by the gripper 6 at a given timing, and is electrostatically wound around the transfer drum 8 by means of the contacting roller 7 and an electrode set opposingly to the contacting roller 7. The transfer drum 8 is rotated in the direction of the arrow in FIG. 2 in synchronization with the photosensitive drum 2. A visible image formed by the development with the yellow developing assembly 4Y is transferred to the recording medium by means of the transfer corona assembly 9 at the portion at which the periphery of the photosensitive drum 2 and the periphery of the transfer drum 8 come into contact with each other. The transfer drum 8** is continued rotating without stop, and stands ready for a next color (magenta as viewed in FIG. 2).

The photosensitive drum 2 is destaticized by means of the residual charge eliminating corona assembly 10, and is cleaned through the cleaning means 11. Thereafter, it is again electrostatically charged by means of the primary corona assembly 3, and is subjected to imagewise exposure like the above according to the next magenta signals. The above rotary developing unit is rotated while an electrostatic latent image formed on the photosensitive drum 2 according to the magenta image signals as a result of the imagewise exposure, until the magenta developing assembly 4M is set stationary at the above given developing position, where the prescribed magenta development is carried out. Subsequently, the process as described above is also carried out on a cyan color and a black color each. After transfer steps corresponding to the four colors have been completed, a multi-color visible image formed on the recording medium is destaticized by the corona assemblies 12 and 13, and the recording medium held by the gripper 6 is released therefrom. At the same time, the recording medium is separated from the transfer drum 8 by means of the separating claw 14, and then delivered to the fixing assembly 16 over the delivery belt 15, where the image is fixed by the action of heat and pressure. Thus, the sequence of full-color print is completed and the desired full-color print image is formed.

The fixing assembly 16 is equipped with a heat-fixing roller 161 and a pressure roller 162. The heat-fixing roller 161 may preferably have a surface layer formed of a material with excellent release properties, such as silicone rubber. The surface layer of the pressure roller 162 may preferably be formed of a fluorine resin.

According to the present invention, the recording medium has the wax component absorption layer formed of the resin capable of inhibiting crystal growth of the wax component. Hence, the wax component does not exude even when fixed toner images are formed using a toner containing the wax component. Since also no oil is used in the course of fixing, fixed toner images free from stickiness due to oil and having a good quality can be obtained. When used in OHPs, color or full-color projected images having a good color reproduction can be obtained without making the projected images grayish as a whole. Such effects can be obtained by the present invention.

EXAMPLES

The present invention will be specifically described below by giving Examples. In the following, "part(s)" refers to "part(s) by weight".

Example 1

Into 709 parts of ion-exchanged water, 451 parts of an aqueous 0.1M-$Na_3PO_4$ solution was introduced, and the mixture was heated to 60° C., followed by stirring at 12,000 rpm using a TK-type homomixer (manufactured by Tokushu Kika Kogyo Co., Ltd.). Then, 67.7 parts of an aqueous 1.0M-$CaCl_2$ solution was added thereto little by little to give a dispersion medium containing $Ca_3(PO_4)_2$.

| | |
|---|---|
| Styrene | 170 parts |
| 2-Ethylhexyl acrylate | 30 parts |
| Paraffin wax (melting point: 75° C.) | 60 parts |
| C.I. Pigment Blue 15:3 | 10 parts |
| Styrene/methacrylic acid/methyl methacrylate copolymer | 5 parts |
| Di-tert-butylsalicylic acid metal compound | 3 parts |

Of the above materials, only the C.I. Pigment Blue 15:3, di-tert-butylsalicylic acid metal compound and styrene were premixed using Ebara Milder (manufactured by Ebara Corp.). Next, all the materials were heated to 60° C., and dissolved and dispersed to give a monomer mixture. While maintaining the mixture at 60° C., 10 parts of an initiator dimethyl-2,2'-azobisisobutyrate was added and dissolved therein. A monomer composition was thus prepared.

The monomer composition obtained was introduced into the dispersion medium prepared in the 2 liter flask of the above homomixer, followed by stirring at 10,000 rpm for 20 minutes at 60° C. using the TK homomixer in an atmosphere of nitrogen, to carry out granulation of the monomer composition. Thereafter, while stirring with paddle stirring blades, the reaction was carried out at 60° C. for 3 hours, and then the temperature was raised to 80° C. to carry out polymerization for further 10 hours.

After the polymerization reaction was completed, the reaction product was cooled, and hydrochloric acid was added to dissolve the $Ca_3(PO_4)_2$, followed by filtration, washing with water and drying to give a polymerization toner.

Particle diameter of the toner obtained was measured using a Coulter counter to reveal that the toner had a weight average particle diameter of 8.2 μm and had a sharp particle size distribution. Cross sections of the particles were also observed on a transmission electron microscope by the dyed ultra-thin sections method. As a result, the particles were each structurally separated into the surface layer mainly composed of styrene-acrylic resin and the core mainly composed of the wax, and it was ascertained that they had a capsulate structure.

Next, based on 100 parts by weight of the toner thus obtained, 0.7 part of hydrophobic silica having a BET specific surface area of 200 $m^2/g$ was externally added. Based on 7 parts of this toner, 93 parts of a Cu—Zn—Fe ferrite carrier whose particle surfaces had been coated with a styrene/methyl methacrylate copolymer was blended to give a blue developer.

Using this developer, images were reproduced using a commercially available full-color copying machine (CLC-500, manufactured by Canon Inc.). Development was carried out under conditions of a development contrast of 320 V in an environment of temperature 23° C. and humidity 65%RH.

On an about 70 μm thick substrate layer made of a thermoresistant resin comprising polyethylene terephthalate (PET), polybutadiene (melting point: 140° C.) was coated as the wax component absorption layer by bar coating so as to have a dried coating thickness of 5 μm, followed by drying in a drying stove at 125° C. for 5 minutes. Recording medium A was thus prepared.

Using this recording medium A, unfixed images were formed only by development and transfer carried out using a modified machine of CLC-500. The unfixed images on the recording medium A were fixed using an external fixing assembly (a fluorine type soft roller was used as the fixing roller, and a silicone type roller as the pressure roller) without any application of oil.

The fixed images obtained had been formed without offset, and were clean and transparent images free from marks of the exudation of wax components. The images were actually tried for projection using an overhead projector. As a result, very beautiful, cyan color projected images were obtained.

The light transmittance of the polybutadiene (melting point: 140° C.) that formed the wax component absorption layer, as measured according to the following procedure of measuring the rate of increase (%) in light transmittance of resin, was increased by a rate of 64.4%.

Measurement of the rate of increase (%) in light transmittance of resin:

Preparation of image sample

On a 70 μm thick substrate layer made of a thermoresistant resin comprising polyethylene terephthalate, the resin that forms the wax component absorption layer is coated by bar coating so as to have a dried coating thickness of 5 μm, followed by drying in a drying stove at 100° C. for 5 minutes. Thus, a recording medium comprising a substrate layer on which a wax component absorption layer has been formed is prepared. This is denoted as recording medium (i).

A recording medium having a 70 μm thick substrate layer made of a thermoresistant resin comprising polyethylene terephthalate and on which no wax component absorption layer has been formed is denoted as recording medium (ii).

Using the blue developer prepared in Example 1 shown above, images are reproduced in the same manner as in Example 1 and fixed to each of the recording medium (i) and the recording medium (ii) to produce image sample (i) and image sample (ii), respectively. (At this time, the quantity of the toner on the recording medium before fixing is controlled to be 0.75 $mg/cm^2$).

Measurement of light transmittance

Light transmittance is measured using Shimadzu Autographic Spectrophotometer UV2200 (manufactured by Shimadzu Corporation). Light transmittances (i) and (ii) of the image samples (i) and (ii), respectively, are measured at a measurement wavelength of 500 nm on the basis of a reference recording medium (light transmittance of the recording medium is regarded as 100%).

Calculation of rate of increase (%) in light transmittance

The rate of increase (%) in the light transmittance of the image sample (i), which comprises recording medium (i) having the fixed toner image also used to produce image sample (ii), is calculated according to the following expression. Rate of increase (%) in light transmittance:

100 Light transmittance (ii)×100 Light transmittance (i)

Example 2

Images were reproduced and fixed using the same copying machine, under the same development conditions and using the same developer as used in Example 1 except that recording medium B was used as a recording medium, which was prepared by coating polyisoprene (melting point: 125° C.) as the wax component absorption layer on an about 100 μm thick PET substrate layer by bar coating so as to have a dried coating thickness of 5 μm, followed by drying in a drying stove at 100° C. for 5 minutes.

As a result, like Example 1, beautiful fixed images free from marks of the exudation of wax components were obtained.

The light transmittance of the polyisoprene (melting point: 125° C.) that formed the wax component absorption layer, as measured according to the procedure of measuring the rate of increase (%) in light transmittance of resin as described in Example 1, was increased by a rate of 71.1%.

Comparative Example 1

Images were reproduced and fixed in the same manner as in Example 1 except that the recording medium A used therein was replaced with a commercially available film for overhead projectors (Transparency OHP Film for NP Series, available from Canon Sales Inc.), the film being a destaticized polyethylene terephthalate film. As a result, although no offset occurred by virtue of the wax component encapsulated into toner particles, marks of the exudation of wax components were seen at rear ends of image portions, and also images with a low transparency as a whole were obtained.

Example 3

Images were reproduced and fixed in the same manner as in Example 1 except that the recording medium A used therein was replaced with recording medium C prepared by similarly coating polybutadiene having a melting point of 156° C. As a result, although no offset occurred by virtue of the wax component encapsulated into toner particles, the wax component absorption performance was lower than that in Example 1, and images with a slightly low transparency as a whole were obtained, which, however, were well at the level acceptable for practical use.

The light transmittance of the polybutadiene (melting point: 156° C.) that formed the wax component absorption layer, as measured according to the procedure of measuring the rate of increase (%) in light transmittance of resin as described in Example 1, was increased by a rate of 60.0%.

Example 4

With regard to the toner used in Example 1, a magenta toner was obtained in the same manner as in Example 1 except that the C.I. Pigment Blue 15:3 was replace with 9 parts by weight of C.I. Pigment Red 122, and a red developer was prepared in the same way.

Images were reproduced and fixed on the recording medium A in the same manner as in Example 1 except that the blue developer used therein was replaced with the above red developer. As a result, like Example 1, the fixed images obtained had been formed without offset, and were clean and transparent images free from marks of the exudation of wax components. The images were actually tried for projection using an overhead projector. As a result, very beautiful, magenta color projected images were obtained.

Example 5

With regard to the toner used in Example 1, a yellow toner was obtained in the same manner as in Example 1 except that the C.I. Pigment Blue 15:3 was replaced with 8 parts by weight of C.I. Pigment Yellow 17, and a yellow developer was prepared in the same way.

Images were reproduced and fixed on the recording medium A in the same manner as in Example 1 except that the blue developer used therein was replaced with the above yellow developer. As a result, like Example 1, the fixed images obtained had been formed without offset, and were clean and transparent images free from marks of the exudation of wax components. The images were actually tried for projection using an overhead projector. As a result, very beautiful, yellow color projected images were obtained.

Example 6

With regard to the toner used in Example 1, a black toner was obtained in the same manner as in Example 1 except that the C.I. Pigment Blue 15:3 was replaced with 12 parts by weight of commercially available carbon black, and a black developer was prepared in the same way.

Images were reproduced and fixed on the recording medium A in the same manner as in Example 1 except that the blue developer used therein was replaced with the above black developer. As a result, like Example 1, the fixed images obtained had been formed without offset, and were clean images free from marks of the exudation of wax components. The images were actually tried for projection using an overhead projector. As a result, very beautiful, black color projected images were obtained.

Example 7

Using the four color developers, the blue developer as used in Example 1, the red developer as used in Example 4, the yellow developer as used in Example 5 and the black developer as used in Example 6, full-color unfixed images were formed only by development and transfer carried out using a modified machine of CLC-500. The unfixed images were fixed using an external fixing assembly (a fluorine type soft roller was used as the fixing roller, and a silicone type roller as the pressure roller) without any application of oil.

The recording medium used here was the recording medium A as used in Example 1, having the wax component absorption layer.

The fixed images obtained had been formed without offset, and were images with a good quality, entirely free from marks of the exudation of wax components.

The fixed images were tried for projection using an overhead projector in the same manner as in Example 1. As a result, very beautiful full-color images were obtained. Moreover, the recording medium having the fixed images, which were full-color images obtained without any application of oil, had no sticky feeling and also showed a superior storage stability.

Example 8

A cyan toner was prepared in the same manner as in Example 1 except that the paraffin wax used therein was replaced with a polyolefin wax having a melting point of 89° C. Images were reproduced and fixed on the recording medium A as used in Example 1, having the wax component absorption layer.

The fixed images obtained were transparent images having a superior transparency, but offset was only partly seen during the running, which, however, was well at the level acceptable for practical use.

Example 9

| | |
|---|---|
| Styrene/butyl acrylate copolymer | 100 parts |
| Polyolefin wax (melting point: 100° C.) | 7 parts |
| Phthalocyanine pigment | 4.5 parts |
| Di-tert-butylsalicylic acid metal compound | 3 parts |

The above materials were mixed, and then the mixture was melt-kneaded using a twin-screw kneading extruder. Thereafter, the kneaded product was cooled, and then pulverized using an air-current type pulverizer, followed by classification by means of an air classifier to give a blue powder toner with a weight average particle diameter of about 8.5 μm. To 100 parts of this toner, 0.8 part of negatively chargeable colloidal silica was externally added to give a cyan toner. This cyan toner and ferrite particles coated with a fluorine-containing acrylic resin were blended in a proportion of 1:9. A blue developer was thus obtained.

On an about 100 μm thick substrate layer made of a thermoresistant resin comprising PET, polybutadiene (melting point: 140° C.) was coated as the wax component absorption layer by bar coating so as to have a dried coating thickness of 5 μm, followed by drying in a drying stove at 125° C. for 5 minutes. Recording medium D was thus prepared.

Using the above blue developer and using a modified machine of CLC-500, images were reproduced on the recording medium D to obtain unfixed images.

To carry out fixing, used was an external fixing assembly employing a fluorine type soft roller as the upper roller and a silicone rubber roller as the lower roller and having no function of application of oil.

A fixing test was made using the above fixing assembly. As a result, even though no oil was applied, fixed images were obtained without causing any offset phenomenon. Moreover, the images showed no loss of transparency, and also no flow-out of wax components occurred.

The light transmittance of the polybutadiene (melting point: 140° C.) that formed the wax component absorption layer, as measured according to the procedure of measuring the rate of increase (%) in light transmittance of resin as described in Example 1, was increased by a rate of 64.4%.

Example 10

| | |
|---|---|
| Polyester | 100 parts |
| Paraffin wax (melting point: 80° C.) | 3 parts |
| Phthalocyanine pigment | 4.5 parts |
| Di-tert-butylsalicylic acid metal compound | 3 parts |

According to the above formulation, a cyan toner was obtained in the same manner as in Example 9, and a blue developer was obtained in the same way.

On an about 100 μm thick substrate layer made of a thermoresistant resin comprising PET, polybutadiene (melting point: 125° C.) was coated as the wax component absorption layer by bar coating so as to have a dried coating thickness of 2 μm, followed by drying in a drying stove at 110° C. for 6 minutes. Recording medium E was thus prepared.

Unfixed images were obtained on the recording medium E in the same manner as in Example 9. A fixing test was similarly made.

As a result, fixed images with an excellent transparency were obtainable without any application of oil.

The light transmittance of the polybutadiene (melting point: 125° C.) that formed the wax component absorption layer, as measured according to the procedure of measuring the rate of increase (%) in light transmittance of resin as described in Example 1, was increased by a rate of 71.1%.

Example 11

With regard to the toner used in Example 9, a magenta toner was obtained in the same manner as in Example 9 except that the C.I. Pigment Blue 15:3 was replaced with 9 parts by weight of C.I. Pigment Red 122, and a red developer was prepared in the same way.

Images were reproduced and fixed on the recording medium D in the same manner as in Example 9 except that the blue developer used therein was replaced with the above red developer. As a result, like Example 9, the fixed images obtained had been formed without offset and showed no loss of transparency, and also no flow-out of wax components occurred.

Example 12

With regard to the toner used in Example 9, a yellow toner was obtained in the same manner as in Example 9 except that the C.I. Pigment Blue 15:3 was replaced with 8 parts by weight of C.I. Pigment Yellow 17, and a yellow developer was prepared in the same way.

Images were reproduced and fixed on the recording medium D in the same manner as in Example 9 except that the blue developer used therein was replaced with the above yellow developer. As a result, like Example 9, the fixed images obtained had been formed without offset and showed no loss of transparency, and also no flow-out of wax components occurred.

Example 13

With regard to the toner used in Example 9, a black toner was obtained in the same manner as in Example 9 except that the C.I. Pigment Blue 15:3 was replaced with 12 parts by weight of commercially available carbon black, and a black developer was prepared in the same way.

Images were reproduced and fixed on the recording medium D in the same manner as in Example 9 except that the blue developer used therein was replaced with the above black developer. As a result, like Example 9, the fixed images obtained had been formed without offset and showed no loss of transparency, and also no flow-out of wax components occurred.

Example 14

Using the four color developers, the blue developer as used in Example 10, the red developer as used in Example 11, the yellow developer as used in Example 12 and the black developer as used in Example 13, full-color unfixed images were formed only by development and transfer carried out using a modified machine of CLC-500. The unfixed images were fixed using an external fixing assembly (a fluorine type soft roller was used as the fixing roller, and a silicone type roller as the pressure roller) without any application of oil.

The recording medium used here was the recording medium D as used in Example 9, having the wax component absorption layer.

The fixed images obtained had been formed without offset, and were images with a good quality, entirely free from marks of the exudation of wax components.

The fixed images were tried for projection using an overhead projector. As a result, very beautiful full-color images were obtained. Moreover, the recording medium having the fixed images, which were full-color images obtained without any application of oil, had no sticky feeling and also showed a superior storage stability.

Example 15

On an about 70 μm thick substrate layer made of a thermoresistant resin comprising PET, polyisoprene (melting point: 125° C.) was coated as the wax component absorption layer by bar coating so as to have a dried coating thickness of 5 μm, followed by drying in a drying stove at 100° C. for 5 minutes. Recording medium F was thus prepared.

Unfixed images were obtained on the recording medium F in the same manner as in Example 9 except for use of this recording medium F. A fixing test was similarly made.

As a result, like Example 9, beautiful fixed images free from marks of the exudation of wax components were obtained.

The light transmittance of the polyisoprene (melting point: 125° C.) that formed the wax component absorption layer, as measured according to the procedure of measuring the rate of increase (%) in light transmittance of resin as described in Example 1, was increased by a rate of 66.7%.

Comparative Example 2

Images were reproduced and fixed in the same manner as in Example 9 except that the recording medium D used therein was replaced with a commercially available film for overhead projectors (Transparency OHP Film for NP Series, available from Canon Sales Inc.), the film being a destaticized polyethylene terephthalate film. As a result, although no offset occurred by virtue of the wax component encapsulated into toner particles, marks of the exudation of wax components were seen at rear ends of image portions, and also images with a low transparency as a whole were obtained.

Example 16

Images were reproduced and fixed in the same manner as in Example 9 except that recording medium D used therein was replaced with a recording medium G, prepared by coating polybutadiene (melting point: 95° C.) as the wax component absorption layer on an about 100 μm thick substrate layer made of a thermoresistant resin comprising PET, by bar coating so as to have a dried coating thickness of 5 μm, followed by drying in a drying stove at 125° C. for 5 minutes. As a result, the offset tended to occur and separation of film sometimes occurred when fixing temperature was too high. When it was too low, the toner showed no satisfactory fixing performance to give images with a lower transparency than that in Example 9, and its practically applicable fixing temperature range was very narrow. However, beautiful fixed images free from marks of the exudation of wax components were obtained within the practically applicable fixing temperature range.

The light transmittance of the polybutadiene (melting point: 95° C.) that formed the wax component absorption layer, as measured according to the procedure of measuring the rate of increase (%) in light transmittance of resin as described in Example 1, was increased by a rate of 84.4%.

Example 17

Using as a developer the blue developer as prepared in Example 1, images were reproduced using CLC-500. Development was carried out under conditions of a development contrast of 320 V in an environment of temperature 23° C. and humidity 65%RH.

On an about 70 μm thick substrate layer made of a thermoresistant resin comprising PET, a 10% MEK solution of an α-olefin/maleate copolymer DIACARNA 30 (available from Mitsubishi Chemical Industries Limited) having been left for a month or more in an environment of humidity 65% and temperature 40° C. until it had undergone ring opening by 90% or more (its structure had been ascertained by IR) was coated as the wax component absorption layer by bar coating so as to have a dried coating thickness of 8 μm, followed by drying in a drying stove. Recording medium H was thus prepared.

Using this recording medium H, unfixed images were formed on the recording medium only by development and transfer carried out using a modified machine of CLC-500. The unfixed images on the recording medium were fixed using an external fixing assembly (having the same roller construction as that of the commercially available CLC-500; having no function of application of oil). The fixing was carried out at a speed of 20 m/sec.

The fixed images obtained had been formed without offset, and were clean and transparent images free from marks of the exudation of wax components. The images were actually tried for projection using an overhead projector. As a result, very beautiful, cyan color images were obtained.

Example 18

On an about 100 μm thick substrate layer made of a thermoresistant resin comprising PET, a 10% MEK solution of an α-olefin/maleic anhydride copolymer DIACARNA 30 (available from Mitsubishi Chemical Industries Limited) was coated as the wax component absorption layer by bar coating so as to have a dried coating thickness of 5 μm, followed by drying in a drying stove to obtain recording medium I. Images were reproduced and fixed to obtain fixed images in the same manner as in Example 17 except that the recording medium I was used.

As a result, like Example 17, beautiful fixed images free from marks of the exudation of wax components were obtained.

The light transmittance of the α-olefin/maleic anhydride copolymer that formed the wax component absorption layer, as measured according to the procedure of measuring the rate of increase (%) in light transmittance of resin as described in Example 1, was increased by a rate of 68.9%.

Example 19

With regard to the toner used in Example 17, a magenta toner was obtained in the same manner as in Example 17 except that the C.I. Pigment Blue 15:3 was replaced with 10 parts by weight of C.I. Pigment Red 122, and a red developer was prepared in the same way.

Images were reproduced and fixed on the recording medium H in the same manner as in Example 17 except that the blue developer used therein was replaced with the above red developer. As a result, like Example 17, the fixed images obtained had been formed without offset, and were clean and transparent images free from marks of the exudation of wax components. The images were actually tried for projection using an overhead projector. As a result, very beautiful, magenta color images were obtained.

Example 20

With regard to the toner used in Example 17, a yellow toner was obtained in the same manner as in Example 17 except that the C.I. Pigment Blue 15:3 was replaced with 8 parts by weight of C.I. Pigment Yellow 17, and a yellow developer was prepared in the same way.

Images were reproduced and fixed on the recording medium H in the same manner as in Example 17 except that the blue developer used therein was replaced with the above yellow developer. As a result, like Example 17, the fixed images obtained had been formed without offset, and were clean and transparent images free from marks of the exudation of wax components. The images were actually tried for projection using an overhead projector. As a result, very beautiful, yellow color images were obtained.

Example 21

With regard to the toner used in Example 17, a black toner was obtained in the same manner as in Example 17 except that the C.I. Pigment Blue 15:3 was replaced with 12 parts by weight of commercially available carbon black, and a black developer was prepared in the same way.

Images were reproduced and fixed on the recording medium H in the same manner as in Example 17 except that the blue developer used therein was replaced with the above black developer. As a result, like Example 17, the fixed images obtained had been formed without offset, and were clean images free from marks of the exudation of wax components. The images were actually tried for projection using an overhead projector. As a result, very beautiful, black co/or projected images were obtained.

Example 22

Using the four color developers, the blue developer as used in Example 17, the red developer as used in Example 19, the yellow developer as used in Example 20 and the black developer as used in Example 21, full-color unfixed images were formed only by development and transfer carried out using a modified machine of CLC-500. The unfixed images were fixed using an external fixing assembly (a fluorine type soft roller was used as the fixing roller, and a silicone type roller as the pressure roller) without any application of oil.

The recording medium used here was the recording medium H as used in Example 17, having the wax component absorption layer.

The fixed images obtained had been formed without offset, and were images with a good quality, entirely free from marks of the exudation of wax components.

The fixed images were tried for projection using an overhead projector in the same manner as in Example 17. As a result, very beautiful full-color images were obtained. Moreover, the recording medium having the fixed images, which were full-color images obtained without any application of oil, had no sticky feeling and also showed a superior storage stability.

Comparative Example 3

Images were reproduced and fixed in the same manner as in Example 17except that the recording medium H used therein was replaced with a commercially available film for overhead projectors (Transparency OHP Film for NP Series, available from Canon Sales Inc.), the film being a destaticized polyethylene terephthalate film. As a result, although no offset occurred by virtue of the wax component encapsulated into toner particles, marks of the exudation of wax components were seen at rear ends of image portions, and also images with a low transparency as a whole were obtained.

Example 23

Images were reproduced and fixed in the same manner as in Example 17except that recording medium H used therein was replaced with a recording medium J, prepared by coating the α-olefin/maleate copolymer as used in Example 17as the wax component absorption layer on an about 70 μm thick substrate layer made of a thermoresistant resin comprising PET, by bar coating so as to have a dried coating thickness of 36 μm.

The images obtained were images having a slightly blurred feeling as a whole compared with those in Example 17, but free from marks of the exudation of wax components, and were at the level acceptable for practical use.

Comparative Example 4

Images were reproduced and fixed in the same manner as in Example 17except that the blue developer used therein was replaced with a blue developer having a toner from which the paraffin wax of the toner in the blue developer had been removed. As a result, an offset phenomenon occurred and no good fixed images were obtained.

Example 24

On an about 70 μm thick substrate layer made of a thermoresistant resin comprising PET, a 10% MEK solution of an ethylene/vinyl acetate copolymer was coated as the wax component absorption layer by bar coating so as to have a dried coating thickness of 8 μm, followed by drying in a drying stove to obtain recording medium K. Images were reproduced and fixed in the same manner as in Example 17 except that the recording medium K was used.

The fixed images obtained had been formed without offset, and were clean and transparent images free from marks of the exudation of wax components. The images were actually tried for projection using an overhead projector. As a result, very beautiful, cyan color images were obtained.

The light transmittance of the ethylene/vinyl acetate copolymer that formed the wax component absorption layer, as measured according to the procedure of measuring the rate of increase (%) in light transmittance of resin as described in Example 1, was increased by a rate of 62.2%.

Example 25

On an about 100 μm thick substrate layer made of a thermoresistant resin comprising PET, a 10% MEK solution of an ethylene/lauryl acrylate copolymer was coated as the wax component absorption layer by bar coating so as to have a dried coating thickness of 5 μm, followed by drying in a drying stove at 150° C. for 5 minutes to obtain recording medium L. Images were reproduced and fixed in the same manner as in Example 17 except that the recording medium L was used.

Like those in Example 17, the fixed images obtained had been formed without offset, and were clean and transparent images free from marks of the exudation of wax components. The images were actually tried for projection using an overhead projector. As a result, very beautiful, cyan color images were obtained.

The light transmittance of the ethylene/lauryl acrylate copolymer that formed the wax component absorption layer, as measured according to the procedure of measuring the rate of increase (%) in light transmittance of resin as described in Example 1, was increased by a rate of 55.6%.

Example 26

On an about 70 μm thick substrate layer made of a thermoresistant resin comprising PET, a 10% MEK solution of an ethylene/vinyl acetate copolymer was coated as the wax component absorption layer by bar coating so as to have a dried coating thickness of 32 μm, followed by drying in a drying stove to obtain recording medium M. Images were reproduced and fixed in the same manner as in Example 17except that the recording medium M was used.

The images obtained were images having a slightly blurred feeling as a whole compared with those in Example 17, but free from marks of the exudation of wax components, and were at the level acceptable for practical use.

The light transmittance of the ethylene/vinyl acetate copolymer that formed the wax component absorption layer, as measured according to the procedure of measuring the rate of increase (%) in light transmittance of resin as described in Example 1, was increased by a rate of 62.2%.

Example 27

Images were reproduced and fixed in the same manner as in Example 1 except that the paraffin wax having a melting point of 75° C. used therein was replaced with a paraffin wax having a melting point of 55° C.

Like those in Example 1, the fixed images obtained had been formed without offset, and were clean and transparent images free from marks of the exudation of wax components. The images were actually tried for projection using an overhead projector. As a result, very beautiful, cyan color images were obtained.

Example 28

Images were reproduced and fixed in the same manner as in Example 1 except that the paraffin wax having a melting point of 75° C. used therein was replaced with a paraffin wax having a melting point of 85° C.

Like those in Example 1, the fixed images obtained had been formed without offset, and were clean and transparent images free from marks of the exudation of wax components. The images were actually tried for projection using an overhead projector. As a result, very beautiful, cyan color images were obtained.

What is claimed is:

1. An image forming method comprising the steps of:

providing a recording medium comprising a laminated film having a substrate layer and a wax component absorption layer;

fixing a toner image comprised of a toner containing a wax component on the recording medium by applying heat and pressure to the recording medium; and absorbing a wax component flowing from the toner due to fixing performed in said fixing step using the wax component absorption layer so as to prevent crystal growth of the wax component;

wherein the wax component absorption layer comprises a resin capable of inhibiting crystal growth of the wax component contained in the toner and thereby increasing light transmittance by at least 20% in a toner image-fixed recording medium in an amount sufficient to inhibit crystal growth of the wax component, wherein a difference between a melting point of the resin in the wax component absorption layer and a melting point of the wax component is not more than 100° C., and wherein the toner comprises a pulverization toner obtained by kneading toner materials containing the wax component followed by pulverization, the pulverization toner containing the wax component in an amount of from 0.1% by weight to 10% by weight based on the weight of the toner.

2. An image forming method according to claim 1, wherein the resin capable of inhibiting crystal growth of the wax component in said fixing step comprises an unsaturated resin having no functional group in its molecular structure.

3. An image forming method according to claim 2, wherein the unsaturated resin comprises a homopolymer selected from the group consisting of polybutadiene, polyisoprene, poly(1-chloro-1-butylene), poly(octachloro-4-methyl-1-butylene), poly(4-methyloxy-1-butylene), poly(1-phenyl-1-butylene), polyvinylethylene, poly (methoxycarbonyl-3-methyl-1-butylene), poly(1,2-dimethyl-1-butylene) and poly(1-t-1-butylene), or a copolymer thereof.

4. An image forming method according to claim 1, wherein said resin capable of inhibiting crystal growth of the wax component comprises a random copolymer or block copolymer of an α-olefin with a vinyl monomer having a polar group or an aromatic group.

5. An image forming method according to claim 4, wherein said random copolymer or block copolymer of an α-olefin with a vinyl monomer having a polar group or an aromatic group comprises a copolymer selected from the group consisting of an α-olefin/maleate copolymer, an α-olefin/maleic anhydride copolymer, an ethylene/vinyl acetate copolymer and an ethylene/acrylate copolymer.

6. An image forming method according to claim 1, wherein said substrate layer has a thermal deformation temperature of 145° C. or above.

7. An image forming method according to claim 1, wherein said substrate layer has a thermal deformation temperature of 150° C. or above.

8. An image forming method according to claim 1, wherein said substrate layer has a layer thickness of from 50 μm to 300 μm.

9. An image forming method according to claim 1, wherein said substrate layer has a layer thickness of from 70 μm to 200 μm.

10. An image forming method according to claim 1, wherein said substrate layer has a layer thickness of from 70 μm to 150 μm.

11. An image forming method according to claim 1, wherein the wax component absorption layer in said fixing step is formed by coating the surface of the substrate layer with a solution comprising a resin dissolved in a volatile organic solvent.

12. An image forming method according to claim 1, wherein said substrate layer has a surface which has been subjected to surface treatment for improving its adhesion to the wax component absorption layer.

13. An image forming method according to claim 12, wherein said surface treatment applied to the surface of the substrate layer comprises plasma treatment or corona discharge treatment.

14. An image forming method according to claim 1, wherein said substrate layer is provided on its surface with an adhesive layer formed of a resin, for improving adhesion of the substrate layer to the wax component absorption layer.

15. An image forming method according to claim 14, wherein said adhesive layer provided on the surface of the substrate layer comprises a resin selected from the group consisting of a polyester resin, an acrylate resin, a methacrylate resin, a styrene/acrylate copolymer and a styrene/methacrylate copolymer.

16. An image forming method according to claim 1, wherein said wax component absorption layer has a layer thickness of from 0.5 μm to 30 μm.

17. An image forming method according to claim 1, wherein said wax component absorption layer has a layer thickness of from 1 μm to 20 μm.

18. An image forming method according to claim 1, wherein said wax component absorption layer has a layer thickness of from 1 μm to 10 μm.

19. An image forming method according to claim 1, wherein the wax component contained in said toner comprises a wax selected from the group consisting of a paraffin wax, a modified product of a paraffin wax, a polyolefin wax, a modified product of a polyolefin wax, a higher fatty acid, a metal salt of a higher fatty acid, an amide wax and an ester wax.

20. An image forming method according to claim 1, wherein the wax component contained in said toner has a melting point of from 30° C. to 150° C.

21. An image forming method according to claim 1, wherein the wax component contained in said toner has a melting point of from 40° C. to 140° C.

22. An image forming method according to claim 1, wherein the wax component contained in said toner has a melting calorie ΔH of from 50 J/g to 250 J/g.

23. An image forming method according to claim 1, wherein the pulverization toner contains the wax component in an amount of from 0.5% by weight to 7.0% by weight based on the weight of the toner.

24. An image forming method according to claim 1, wherein said toner comprises a color toner containing a colorant, and wherein a color toner image formed using the color toner is fixed to the surface of the recording medium.

25. An image forming method according to claim 1, wherein said toner comprises a cyan toner, a magenta toner, a yellow toner and a black toner, each containing a colorant, and wherein a full-color toner image formed using the cyan toner, the magenta toner, the yellow toner and the black toner is fixed to the surface of the recording medium.

26. An image forming method according to claim 1, wherein the resin has in its molecular structure both (i) a methylene chain or a long-chain alkyl group and (ii) a polar group or an aromatic group.

27. An image forming method according to claim 1, wherein the resin comprises an unsaturated resin having no functional group in its molecular structure, or a resin having in its molecular structure both (i) a methylene chain or a long-chain alkyl group and (ii) a polar group or an aromatic group.

28. An image forming method comprising the steps of:

fixing a toner image formed by a toner containing a wax component on a recording medium by applying heat and pressure to the recording medium, wherein the recording medium comprises a transparent laminated film having a substrate layer and a wax component absorption layer for absorbing the wax component contained in the toner, wherein the wax component absorption layer comprises a resin capable of inhibiting crystal growth of the wax component contained in the toner and thereby increasing light transmittance by at least 20% in a toner image-fixed recording medium in an amount sufficient to inhibit crystal growth of the wax component, wherein a difference between a melting point of the resin in the wax component absorption layer and a melting point of the wax component is not more than 100° C., wherein the toner comprises a pulverization toner obtained by kneading toner material containing the wax component followed by pulverization, the pulverization toner containing the wax component in an amount of from 0.1% by weight to 10% by weight based on the weight of the toner; and increasing a light transmittance of the recording medium having the fixed toner image by at least 20% by absorbing a wax component flowing from the toner due to fixing performed in said fixing step using the wax component absorption layer so as to prevent crystal growth of the wax component.

29. An image forming method according to claim 28, wherein the resin that forms the wax component absorption layer has a melting point which is higher than the melting point of the wax component contained in the toner.

30. An image forming method according to claim 28, wherein the resin capable of inhibiting crystal growth of the wax component in said fixing step comprises an unsaturated resin having no functional group in its molecular structure.

31. An image forming method according to claim 30, wherein the unsaturated resin comprises a homopolymer selected from the group consisting of polybutadiene, polyisoprene, poly(1-chloro-1-butylene), poly(octachloro-4-methyl-1-butylene), poly(4-methyloxy-1-butylene), poly(1-phenyl-1-butylene), polyvinylethylene, poly(methoxycarbonyl-3-methyl-1-butylene), poly(1,2-dimethyl-1-butylene), and poly(1-t-1-butylene), or a copolymer thereof.

32. An image forming method according to claim 28, wherein the resin capable of inhibiting crystal growth of the wax component comprises a random copolymer or block copolymer of an α-olefin with a vinyl monomer having a polar group or an aromatic group.

33. An image forming method according to claim 32, wherein said random copolymer or block copolymer of an α-olefin with a vinyl monomer having a polar group or an aromatic group comprises a copolymer selected from the group consisting of an α-olefin/maleate copolymer, an α-olefin/maleic anhydride copolymer, an ethylene/vinyl acetate copolymer and an ethylene/acrylate copolymer.

34. An image forming method according to claim 28, wherein said substrate layer has a thermal deformation temperature of 145° C. or above.

35. An image forming method according to claim 28, wherein said substrate layer has a thermal deformation temperature of 150° C. or above.

36. An image forming method according to claim 28, wherein said substrate layer has a layer thickness of from 50 μm to 300 μm.

37. An image forming method according to claim 28, wherein said substrate layer has a layer thickness of from 70 μm to 200 μm.

38. An image forming method according to claim 28, wherein said substrate layer has a layer thickness of from 70 μm to 150 μm.

39. An image forming method according to claim 28, wherein the wax component absorption layer in said fixing step is formed by coating the surface of the substrate layer with a solution comprising a resin dissolved in a volatile organic solvent.

40. An image forming method according to claim 28, wherein the substrate layer has a surface which has been subjected to surface treatment for improving its adhesion to the wax component absorption layer.

41. An image forming method according to claim 40, wherein the surface treatment applied to the surface of the substrate layer comprises plasma treatment or corona discharge treatment.

42. An image forming method according to claim 28, wherein the substrate layer is provided on its surface with an adhesive layer formed of a resin for improving adhesion of the substrate layer to the wax component absorption layer.

43. An image forming method according to claim 42, wherein the adhesive layer provided on the surface of the substrate layer comprises a resin selected from the group consisting of a polyester resin, an acrylate resin, a methacrylate resin, a styrene/acrylate copolymer and a styrene/methacrylate copolymer.

44. An image forming method according to claim 28, wherein the wax component absorption layer has a layer thickness of from 0.5 μm to 30 μm.

45. An image forming method according to claim 28, wherein the wax component absorption layer has a layer thickness of from 1 μm to 20 μm.

46. An image forming method according to claim 28, wherein the wax component absorption layer has a layer thickness of from 1 μm to 10 μm.

47. An image forming method according to claim 28, wherein the wax component contained in the toner comprises a wax selected from the group consisting of a paraffin wax, a modified product of a paraffin wax, a polyolefin wax, a modified product of a polyolefin wax, a higher fatty acid, a metal salt of a higher fatty acid, an amide wax, and an ester wax.

48. An image forming method according to claim 28, wherein the wax component contained in the toner has a melting point of from 30° C. to 150° C.

49. An image forming method according to claim 28, wherein the wax component contained in the toner has a melting point of from 40° C. to 140° C.

50. An image forming method according to claim 28, wherein the wax component contained in the toner has a melting calorie ΔH of from 50 J/g to 250 J/g.

51. An image forming method according to claim 28, wherein the pulverization toner contains the wax component in an amount of from 0.5% by weight to 7.0% by weight based on the weight of the toner.

52. An image forming method according to claim 28, wherein the toner comprises a color toner containing a colorant, and wherein a color toner image formed using the color toner is fixed to the surface of the recording medium.

53. An image forming method according to claim 28, wherein the toner comprises a cyan toner, a magenta toner, a yellow toner, and a black toner, each containing a colorant, and wherein a full-color toner image formed using the cyan toner, the magenta toner, the yellow toner and the black toner is fixed to the surface of the recording medium.

54. An image forming method according to claim 28, wherein the resin has in its molecular structure both (i) a methylene chain or a long-chain alkyl group, and (ii) a polar group or an aromatic group.

55. An image forming method according to claim 28, wherein the resin comprises an unsaturated resin having no functional group in its molecular structure, or a resin having in its molecular structure both (i) a methylene chain or a long-chain alkyl group, and (ii) a polar group or an aromatic group.

56. An image forming method according to claim 1, wherein the melting point of the resin of the wax component absorption layer is higher than the melting point of the wax component contained in the pulverization toner.

57. An image forming method comprising the steps of:

providing a recording medium comprising a laminated film having a substrate layer and a wax component absorption layer;

fixing a toner image comprised of a toner containing a wax component on the recording medium by applying heat and pressure to the recording medium; and absorbing a wax component flowing from the toner due to fixing performed in said fixing step using the wax component absorption layer so as to prevent crystal growth of the wax component;

wherein the wax component absorption layer comprises a resin capable of inhibiting crystal growth of the wax component contained in the toner and thereby increasing light transmittance by at least 20% in a toner image-fixed recording medium in an amount sufficient to inhibit crystal growth of the wax component, wherein a difference between a melting point of the resin in the wax component absorption layer and a melting point of the wax component is not more than 100° C., and wherein the toner comprises a polymerization toner obtained by polymerization of a monomer composition in an aqueous phase, the monomer composition comprising at least a polymerizable monomer, a colorant and a wax component in an amount of from 0.1 part by weight to 50 parts by weight based on 100 parts by weight of polymer produced by polymerization of the polymerizable monomer.

58. An image forming method according to claim 57, wherein the resin comprises an unsaturated resin having no functional group in its molecular structure, or a resin having in its molecular structure both (i) a methylene chain or a long-chain alkyl group and (ii) a polar group or an aromatic group.

59. An image forming method according to claim 57, wherein the resin comprises an unsaturated resin having no functional group in its molecular structure.

60. An image forming method according to claim 59, wherein the unsaturated resin comprises a homopolymer selected from the group consisting of polybutadiene, polyisoprene, poly(1-chloro-1-butylene), poly(octachloro-4-methyl-1-butylene), poly(4-methyloxy-1-butylene), poly(1-phenyl-1-butylene), polyvinylethylene, poly(methoxycarbonyl-3-methyl-1-butylene), poly(1,2-dimethyl-1-butylene) and poly(1-t-1-butylene), or a copolymer thereof.

61. An image forming method according to claim 57, wherein the resin has in its molecular structure both (i) a methylene chain or a long-chain alkyl group and (ii) a polar group or an aromatic group.

62. An image forming method according to claim 61, wherein said resin comprises a random copolymer or block copolymer of an α-olefin with a vinyl monomer having a polar group or an aromatic group.

63. An image forming method according to claim 62, wherein the random copolymer or block copolymer of an α-olefin with a vinyl monomer having a polar group or an aromatic group comprises a copolymer selected from the group consisting of an α-olefin/maleate copolymer, an α-olefin/maleic anhydride copolymer, an ethylene/vinyl acetate copolymer and an ethylene/acrylate copolymer.

64. An image forming method according to claim 57, wherein the melting point of the resin of the wax component absorption layer is higher than the melting point of the wax component contained in the polymerization toner.

65. An image forming method according to claim 57, wherein the substrate layer has a thermal deformation temperature of 145° C. or above.

66. An image forming method according to claim 57, wherein the substrate layer has a thermal deformation temperature of 150° C. or above.

67. An image forming method according to claim 57, wherein the substrate layer has a layer thickness of from 50 μm to 300 μm.

68. An image forming method according to claim 57, wherein the substrate layer has a layer thickness of from 70 μm to 200 μm.

69. An image forming method according to claim 57, wherein the substrate layer has a layer thickness of from 70 μm to 150 μm.

70. An image forming method according to claim 57, wherein the wax component absorption layer is formed by coating the surface of the substrate layer with a solution comprising a resin dissolved in a volatile organic solvent.

71. An image forming method according to claim 57, wherein the substrate layer has a surface which has been subjected to a surface treatment in order to improve adhesion of the substrate layer to the wax component absorption layer.

72. An image forming method according to claim 71, wherein the surface treatment applied to the surface of the substrate layer comprises plasma treatment or corona discharge treatment.

73. An image forming method according to claim 57, wherein a surface of the substrate layer includes an adhesive layer formed of a resin, in order to improve adhesion of the substrate layer to the wax component absorption layer.

74. An image forming method according to claim 73, wherein the adhesive layer on the surface of the substrate layer comprises a resin selected from the group consisting of a polyester resin, an acrylate resin, a methacrylate resin, a styrene/acrylate copolymer and a styrene/methacrylate copolymer.

75. An image forming method according to claim 57, wherein the wax component absorption layer has a layer thickness of from 0.5 μm to 30 μm.

76. An image forming method according to claim 57, wherein the wax component absorption layer has a layer thickness of from 1 μm to 20 μm.

77. An image forming method according to claim 57, wherein the wax component absorption layer has a layer thickness of from 1 μm to 10 μm.

78. An image forming method according to claim 57, wherein the wax component contained in the toner comprises a wax selected from the group consisting of a paraffin wax, a modified product of a paraffin wax, a polyolefin wax, a modified product of a polyolefin wax, a higher fatty acid, a metal salt of a higher fatty acid, an amide wax and an ester wax.

79. An image forming method according to claim 57, wherein the wax component contained in the toner has a melting point of from 30° C. to 150° C.

80. An image forming method according to claim 57, wherein the wax component contained in the toner has a melting point of from 40° C. to 140° C.

81. An image forming method according to claim 57, wherein the wax component contained in the toner has a melting calorie ΔH of from 50 J/g to 250 J/g.

82. An image forming method according to claim 57, wherein the polymerization toner contains the wax component in an amount of from 1 part by weight to 45 parts by weight based on 100 parts by weight of polymerizable monomers.

83. An image forming method according to claim 57, wherein the toner comprises a color toner containing a colorant, and wherein a color toner image is formed by fixing the color toner to a surface of the recording medium.

84. An image forming method according to claim 57, wherein the toner comprises a cyan toner, a magenta toner, a yellow toner and a black toner, each containing a colorant, and wherein a full-color toner image is formed by fixing the cyan toner, the magenta toner, the yellow toner and the black toner to a surface of the recording medium.

85. An image forming method comprising the steps of:

fixing a toner image formed by a toner containing a wax component on a recording medium by applying heat and pressure to the recording medium, wherein the recording medium comprises a transparent laminated film having a substrate layer and a wax component absorption layer for absorbing the wax component contained in the toner, wherein the wax component absorption layer comprises a resin capable of inhibiting crystal growth of the wax component contained in the toner and thereby increasing light transmittance by at least 20% in a toner image-fixed recording medium in an amount sufficient to inhibit crystal growth of the wax component, wherein a difference between a melting point of the resin in the wax component absorption layer and a melting point of the wax component is not more than 100° C., wherein the toner comprises a polymerization toner obtained by polymerization of a monomer composition in an aqueous phase, the monomer composition comprising at least a polymerizable monomer, a colorant and a wax component, the polymerization toner containing the wax component in an amount of from 1 part by weight to 50 parts by weight based on 100 parts by weight of a polymer produced by polymerization of the polymerizable monomer; and increasing a light transmittance of the recording medium having the fixed toner image by at least 20% by absorbing a wax component flowing from the toner due to fixing performed in said fixing step using the wax component absorption layer so as to prevent crystal growth of the wax component.

86. An image forming method according to claim 85, wherein the resin comprising the wax component absorption layer has a melting point which is higher than a melting point of the wax component contained in the toner.

87. An image forming method according to claim 85, wherein the resin comprises an unsaturated resin having no functional group in its molecular structure, or a resin having in its molecular structure both (i) a methylene chain or a long-chain alkyl group, and (ii) a polar group or an aromatic group.

88. An image forming method according to claim 85, wherein the resin comprises an unsaturated resin having no functional group in its molecular structure.

89. An image forming method according to claim 88, wherein the unsaturated resin comprises a homopolymer selected from the group consisting of polybutadiene, polyisoprene, poly(1-chloro-1-butylene), poly(octachloro-4-methyl-1-butylene), poly(4-methyloxy-1-butylene), poly(1-phenyl-1-butylene), polyvinylethylene, poly (methoxycarbonyl- 3-methyl-1-butylene), poly (1,2-dimethyl-1-butylene) and poly(1-t-1-butylene), or a copolymer thereof.

90. An image forming method according to claim 85, wherein the resin has in its molecular structure both (i) a methylene chain or a long-chain alkyl group and (ii) a polar group or an aromatic group.

91. An image forming method according to claim 90, wherein said resin comprises a random copolymer or block copolymer of an α-olefin with a vinyl monomer having a polar group or an aromatic group.

92. An image forming method according to claim 91, wherein the random copolymer or block copolymer of an α-olefin with a vinyl monomer having a polar group or an aromatic group comprises a copolymer selected from the group consisting of an α-olefin/maleate copolymer, an α-olefin/maleic anhydride copolymer, an ethylene/vinyl acetate copolymer and an ethylene/acrylate copolymer.

93. An image forming method according to claim 85, wherein the substrate layer has a thermal deformation temperature of 145° C. or above.

94. An image forming method according to claim 85, wherein the substrate layer has a thermal deformation temperature of 150° C. or above.

95. An image forming method according to claim 85, wherein the substrate layer has a thickness of from 50 μm to 300 μm.

96. An image forming method according to claim 85, wherein the substrate layer has a thickness of from 70 μm to 200 μm.

97. An image forming method according to claim 85, wherein the substrate layer has a thickness of from 70 μm to 150 μm.

98. An image forming method according to claim 85, wherein the wax component absorption layer is formed by coating a surface of the substrate layer with a solution comprising a resin dissolved in a volatile organic solvent.

99. An image forming method according to claim 85, wherein the substrate layer has a surface which has been subjected to a surface treatment in order to improve adhesion of the substrate layer to the wax component absorption layer.

100. An image forming method according to claim 99, wherein the surface treatment applied to the surface of the substrate layer comprises plasma treatment or corona discharge treatment.

101. An image forming method according to claim 85, wherein a surface of the substrate layer includes an adhesive layer formed of a resin, in order to improve adhesion of the substrate layer to the wax component absorption layer.

102. An image forming method according to claim 101, wherein the adhesive layer on the surface of the substrate layer comprises a resin selected from the group consisting of a polyester resin, an acrylate resin, a methacrylate resin, a styrene/acrylate copolymer and a styrene/methacrylate copolymer.

103. An image forming method according to claim 85, wherein the wax component absorption layer has a layer thickness of from 0.5 μm to 30 μm.

104. An image forming method according to claim 85, wherein the wax component absorption layer has a layer thickness of from 1 μm to 20 μm.

105. An image forming method according to claim 85, wherein the wax component absorption layer has a layer thickness of from 1 μm to 10 μm.

106. An image forming method according to claim 85, wherein the wax component contained in the toner comprises a wax selected from the group consisting of a paraffin wax, a modified product of a paraffin wax, a polyolefin wax, a modified product of a polyolefin wax, a higher fatty acid, a metal salt of a higher fatty acid, an amide wax and an ester wax.

107. An image forming method according to claim 85, wherein the wax component contained in the toner has a melting point of from 30° C. to 150° C.

108. An image forming method according to claim 85, wherein the wax component contained in the toner has a melting point of from 40° C. to 140° C.

109. An image forming method according to claim 85, wherein the wax component contained in the toner has a melting calorie ΔH of from 50 J/g to 250 J/g.

110. An image forming method according to claim 85, wherein the polymerization toner contains the wax component in an amount of from 1 part by weight to 45 parts by weight based on 100 parts by weight of polymerizable monomers.

111. An image forming method according to claim 85, wherein the toner comprises a color toner containing a colorant, and wherein a color toner image is formed by fixing the color toner to a surface of the recording medium.

112. An image forming method according to claim 85, wherein the toner comprises a cyan toner, a magenta toner, a yellow toner and a black toner, each containing a colorant, and wherein a full-color toner image is formed by fixing the cyan toner, the magenta toner, the yellow toner and the black toner to a surface of the recording medium.

* * * * *

UNITED STATES PATENT AND TRADEMARK OFFICE

CERTIFICATE OF CORRECTION

PATENT NO. : 5,691,093

DATED : November 25, 1997

INVENTOR(S): MAKOTO KANBAYASHI, ET AL.

It is certified that error appears in the above-identified patent and that said Letters Patent is hereby corrected as shown below:

ON THE TITLE PAGE AT [56], FOREIGN PATENT DOCUMENTS

"7/1936" should read --7/1961--.

ON THE TITLE PAGE AT [57], ABSTRACT

Line 1, "has developing" should read --for developing--.

COLUMN 1

Line 23, "member," should read --member--;
Line 29, "assembly," should read --assembly--.

COLUMN 2

Line 2, "have" should read --has--.

COLUMN 3

Line 28, "well" should read --very--;
Line 56, "color" (third occurrence) should be deleted;
Line 65, "well" should be deleted.

COLUMN 4

Line 21, "is" should read --is to--;
Line 46, "comprising;" should read --comprising:--.

UNITED STATES PATENT AND TRADEMARK OFFICE

CERTIFICATE OF CORRECTION

PATENT NO. : 5,691,093

DATED : November 25, 1997

INVENTOR(S): MAKOTO KANBAYASHI, ET AL.

It is certified that error appears in the above-identified patent and that said Letters Patent is hereby corrected as shown below:

COLUMN 5

Line 61, "one" should read --with one--.

COLUMN 6

Line 4, "resemble" should read --resembles--;
Line 8, "substance" (both occurrences) should read --substances--;
Line 9, "stand" should read --are--;
Line 30, "substituted" should read --synthesized--.

COLUMN 9

Line 8, "such as" (second occurrence) should read --like--;
Line 30, "and" should read --and are--.

COLUMN 10

Line 45, "shells." should read --shell.--.

COLUMN 11

Line 51, "mope" should read --more--;
Line 67, "well" should read --very--.

COLUMN 13

Line 62, "down stream" should read --downstream--.

UNITED STATES PATENT AND TRADEMARK OFFICE

CERTIFICATE OF CORRECTION

PATENT NO. : 5,691,093

DATED : November 25, 1997

INVENTOR(S): MAKOTO KANBAYASHI, ET AL.

It is certified that error appears in the above-identified patent and that said Letters Patent is hereby corrected as shown below:

COLUMN 14

Line 63, "print" should read --printing--.

COLUMN 15

Line 55, "further" should read --another--.

COLUMN 17

Line 12, "100 light transmittance (ii) X 100 light transmittance (i)" should read $$-- 100 - \frac{\text{Light transmittance (ii) X 100}}{\text{Light transmittance (i)}} --.$$

COLUMN 18

Line 1, "replace" should read --replaced--.

COLUMN 23

Line 55, "co/or" should read --color--.

UNITED STATES PATENT AND TRADEMARK OFFICE

CERTIFICATE OF CORRECTION

PATENT NO. : 5,691,093

DATED : November 25, 1997

INVENTOR(S): MAKOTO KANBAYASHI, ET AL.

It is certified that error appears in the above-identified patent and that said Letters Patent is hereby corrected as shown below:

COLUMN 24

Line 18, "17except" should read --17 except--;
Line 31, "17except" should read --17 except--;
Line 34, "17as" should read --17 as--;
Line 46, "17except" should read --17 except--.

COLUMN 25

Line 38, "17except" should read --17 except--.

Signed and Sealed this

Twenty-third Day of June, 1998

*Attest:*

BRUCE LEHMAN

*Attesting Officer*

*Commissioner of Patents and Trademarks*